US009433260B2

(12) United States Patent
Hede et al.

(10) Patent No.: US 9,433,260 B2
(45) Date of Patent: Sep. 6, 2016

(54) BUCKLE DEVICE FOR ADJUSTING AND CLAMPING A STRAP

(71) Applicant: ZEDEL, Crolles (FR)

(72) Inventors: Jean-Marc Hede, Domène (FR); Benoît Bouquier, Corenc (FR)

(73) Assignee: ZEDEL, Crolles (FR)

( * ) Notice: Subject to any disclaimer, the term of this patent is extended or adjusted under 35 U.S.C. 154(b) by 196 days.

(21) Appl. No.: 14/473,283

(22) Filed: Aug. 29, 2014

(65) Prior Publication Data

US 2015/0107067 A1 Apr. 23, 2015

(30) Foreign Application Priority Data

Oct. 17, 2013 (FR) ..... 13 02408

(51) Int. Cl.
*A44B 11/18* (2006.01)
*A44B 11/12* (2006.01)

(52) U.S. Cl.
CPC ..... *A44B 11/18* (2013.01); *A44B 11/125* (2013.01); *Y10T 24/2153* (2015.01)

(58) Field of Classification Search
None
See application file for complete search history.

(56) References Cited

U.S. PATENT DOCUMENTS

| | | | | |
|---|---|---|---|---|
| 491,123 | A * | 2/1893 | McClure | A44B 11/18 24/136 R |
| 5,432,984 | A | 7/1995 | Petzl | |
| 2007/0187445 | A1 | 8/2007 | Krapka | |

FOREIGN PATENT DOCUMENTS

| | | | |
|---|---|---|---|
| EP | 0 614 626 | A1 | 9/1994 |
| FR | 2 996 732 | A1 | 4/2014 |
| JP | 54-10324 | U1 | 1/1979 |
| WO | WO 2005/006906 | A1 | 1/2005 |

* cited by examiner

*Primary Examiner* — Jack W Lavinder
(74) *Attorney, Agent, or Firm* — Oliff PLC

(57) ABSTRACT

An attachment device for tightening an adjustable resistant strap, comprising a buckle composed of a pair of superposed rings of different dimensions. The buckle is associated with a positioning shim housed around a closed first turn arranged opposite the blocking slot of the strap. The positioning shim is configured to separate the top strand and the bottom strand of said turn from one another. This results in a reduction of the friction effect when relative movement takes place between the two rings. The shim is equipped for this purpose with two guide apertures through which the bottom strand and the top strand of the closed turn attached to the buckle respectively pass.

8 Claims, 3 Drawing Sheets

BUCKLE DEVICE FOR ADJUSTING AND CLAMPING A STRAP

BACKGROUND OF THE INVENTION

The invention relates to a buckle device for adjusting and clamping a strap, said buckle being composed of a pair of superposed rings presenting rectangular frames of different dimensions, the larger first ring comprising a first rectangular opening located under a second rectangular opening arranged in the second ring of smaller size so as to define a transverse slot for passage of the strap, the slot being arranged between one of the outer edges of the second ring, and the adjacent side of the first opening of the first ring, the buckle being located either in a blocking position of the strap in the slot following tensioning, or in a releasing position after a relative movement between the two rings resulting in an increase of the passage area in the slot.

Such a buckle is in particular used for securing a safety sit harness strap.

STATE OF THE ART

According to the buckle described in the document EP 614626, the second ring is fitted floating on the first ring and is secured to the latter by a loop of a stitched strap directly surrounding the two rear crosspieces of the rings. The other strap end is jammed in the slot between the two rings as soon as a traction force is applied on the bottom strand. When the bottom strand of the strap is no longer under tension, the jamming effect disappears and the strap can then slide in the slot. In this type of known attachment buckles, it is difficult to perform certain movements necessary for when the resistant strap is under tension. The tension of the strap causes reactions on the top crosspiece and hampers movement of the latter in translation and rotation of the buckle. The two rings are in fact pressed against one another, and the resulting friction effect hampers their relative movement, and pinching of the strap in the slot on the adjustment side is imperfect under certain conditions.

This known type of buckle has been improved by the addition of a tube passing with clearance through the superposed crosspieces of the two rings opposite from the slot. The larger diameter of the tube thus enables the two rings of the buckle to easily slide on one another and to rotate in the fixed strap while keeping their relative movements. The presence of the tube does however increase the overall dimensions of the buckle.

OBJECT OF THE INVENTION

The object of the invention consists in providing a buckle device with double rings wherein the loosening handling operation when the strap is under tension is made easier, without increasing the overall dimensions of the buckle.

The attachment device according to the invention is characterized in that the buckle is associated with a positioning shim housed opposite the slot, surrounding a first closed turn of the strap, said positioning shim separating the top strand and the bottom strand of said turn from one another to reduce the friction effect when relative movement takes place between the two rings.

According to a preferred embodiment, the positioning shim is equipped with two guide apertures through which the bottom strand and the top strand of the closed turn attached to the buckle respectively pass. The two apertures are separated from one another by an intermediate wall in the form of a shim also acting as a stop for the larger first ring.

The presence of the shim according to the invention enables friction to be reduced and the relative sliding movement of the two rings to be enhanced, both when the strap is tightened and loosened. The buckle is free to withdraw when loosening is performed, and free to rotate for complete opening, for example to remove the belt of a harness

BRIEF DESCRIPTION OF THE DRAWINGS

Other advantages and features will become more clearly apparent from the following description of a particular embodiment of the invention given for non-restrictive example purposes only and represented in the appended drawings, in which.

DESCRIPTION OF A PREFERRED EMBODIMENT OF THE INVENTION

Figure 1:
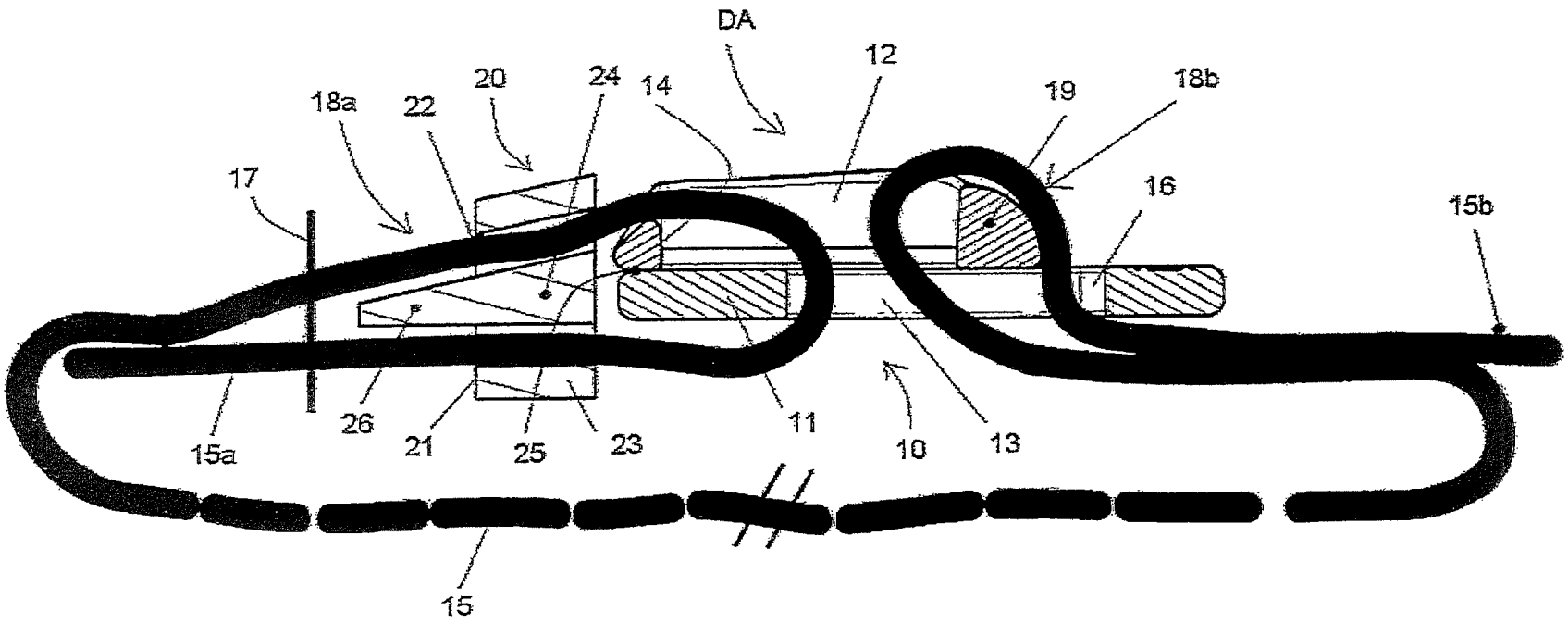
FIG. 1 represents a schematic cross-sectional view of the buckle and shim assembly according to the invention, the strap not being stretched taut, and the buckle being in the released position.
Figure 2:
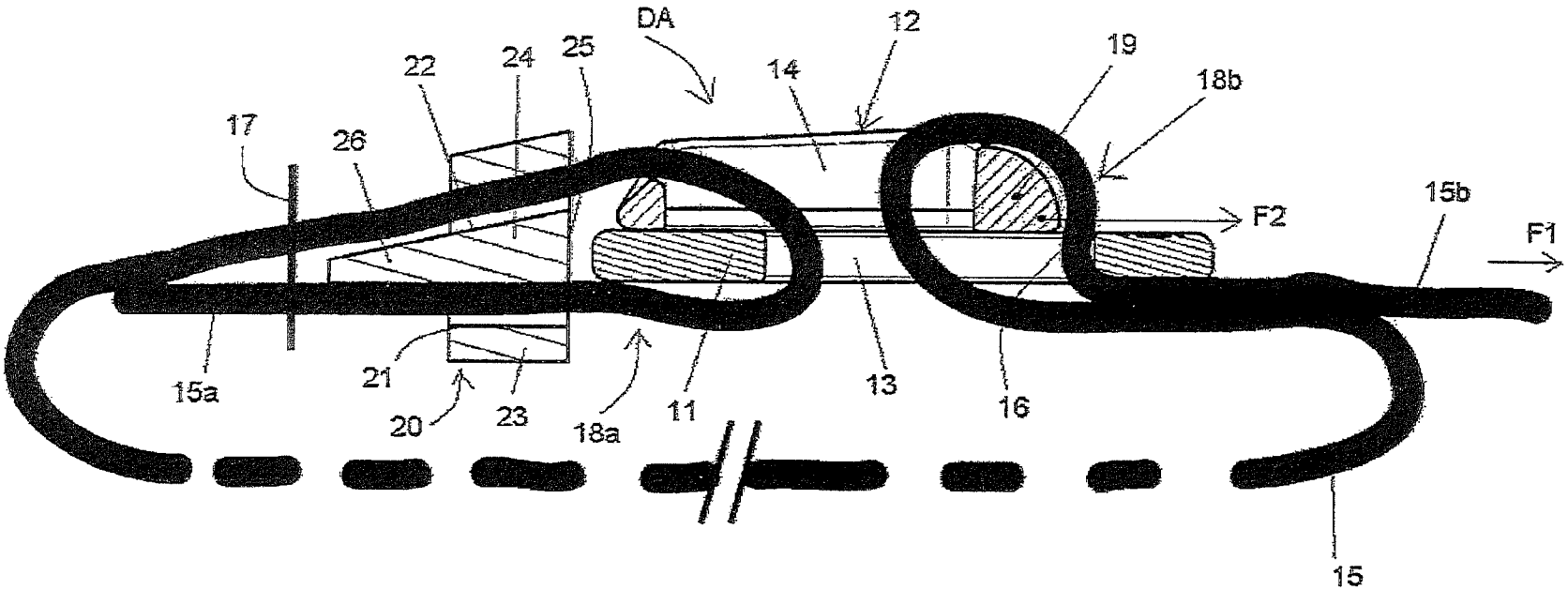
FIG. 2 is an identical view to FIG. 1 when the buckle is clamped in the blocked position.
Figure 3:
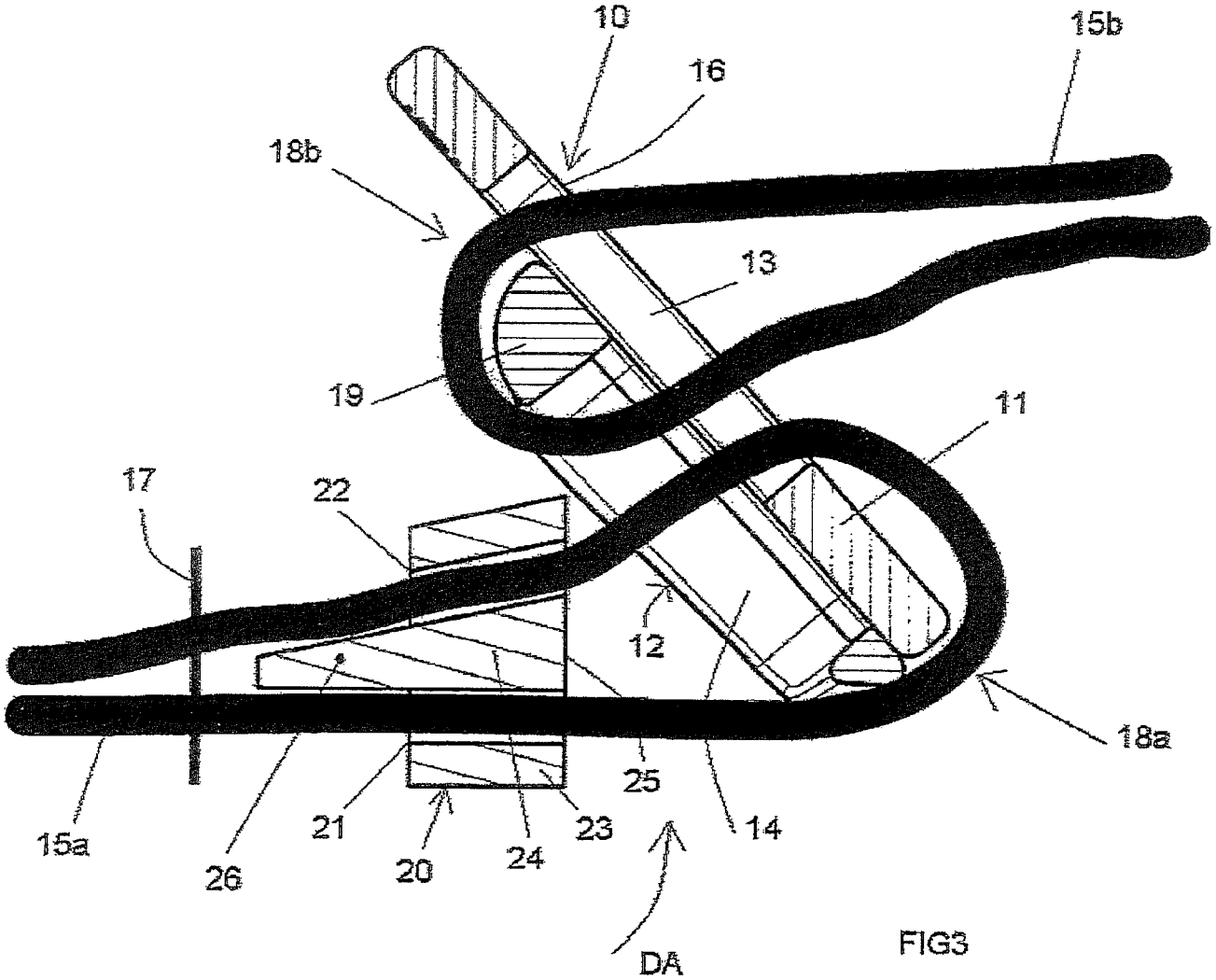
FIG. 3 shows opening of the buckle after rotation of the rings.

In FIGS. 1 to 3, attachment device DA comprises a buckle 10 composed of a pair of superposed rings 11, 12 having rectangular or trapezoid structures of different dimensions. The larger first ring 11 comprises a first opening 13 located underneath a rectangular second opening 14 arranged in second ring 12 which is of smaller size. The width of strap 15 is slightly smaller than that of openings 13, 14 to prevent any friction of strap 15 against the opposite lateral edges of rings 11, 12.

The strap 15 passes through the two openings 13, 14 in the following manner:

End 15*a* (on the left) of strap 15 passes through the two openings 13, 14, forming a first turn 18*a* closed by a seam 17 over the whole width of the strap. Buckle 10 is thus permanently attached to strap 15 by this stitched first turn 18*a*.

End 15*b* (on the right) of strap 15 is then inserted in a transverse slot 16 situated between the outer edge of second ring 12 and the adjacent side of first opening 13. It then passes back through first ring 11 in the opposite direction forming an open second turn 18*b* around the right-hand crosspiece 19 of top second ring 12.

The structure of such an attachment buckle is well known from the document EP 614626.

According to the invention, buckle 10 is associated with a positioning shim 20 housed inside closed first turn 18*a*. This positioning shim 20 surrounds first turn 18*a* over the whole width of the strap. The bottom strand and the top strand of closed first turn 18*a* respectively pass through two superposed apertures 21, 22 arranged in positioning shim 20, which is thus held captive between seam 17 and the ends of the two rings 11, 12. Apertures 21, 22 are formed for example by grooves which pass through shim 20 from side to side in the lengthwise direction.

Preferably, bottom aperture 21 extends parallel to base part 23, whereas the other superposed aperture 22 is inclined forming an acute angle in the direction of seam 17.

The two apertures 21, 22 are delineated and separated from one another by an intermediate wall 24 in the form of a wedge of trapezoid cross-section. The right-hand vertical surface acts as stop 25 for bottom ring 11, whereas wall 24 is extended in the opposite direction by a nose 26 salient from the two apertures 21, 22 in the direction of seam 17.

According to an alternative embodiment, intermediate wall 24 can be devoid of salient nose 26, and the vertical cross-section of the wedge can be different.

Operation of attachment device DA according to the invention is as follows:

In FIG. 1, buckle 10 is in the released position with no tension on strap 15. The jamming of the strand of strap 15 is released in slot 16 following the withdrawal movement of ring 12 in the direction of shim 20.

To perform the required clamping, the user pulls (arrow F1, FIG. 2) on end 15*b* of strap 15 until the required adjustment is achieved. The tension exerted on strap 15 moves top ring 12 in the same direction (arrow F2) to perform jamming of second turn 18*b* in slot 16. Bottom ring 11 remains substantially pressing against stop 25 of shim 20. The two top and bottom strands of first turn 18*a* do not crush the two rings 11, 12 due to positioning shim 20.

FIG. 3 shows the assembly formed by buckle 10 and shim 20 after free rotation of rings 11, 12 in the opening direction. The end of ring 11 simply has to be lifted on the side where turn 18*b* is located making it pivot in the counterclockwise direction. After simultaneous pivoting of the two rings 11, 12 beyond 90°, top ring 12 moves back into first turn 18*a* in the direction of shim 20, resulting in releasing of the strap in slot 16. During this operation, shim 20 remains substantially in place in turn 18*a*.

The presence of shim 20 in closed turn 18*a* enables the friction of the two superposed rings 11, 12 to be reduced when the strap is stretched tight. The relative sliding movement of the two rings 11, 12 is thus made easier, both when strap 15 is tightened and loosened. Buckle 10 is free to withdraw when loosening is performed, and free to rotate for complete opening, for example to remove the belt of a harness.

It is clear that positioning shim 20 can have a different shape from that represented in FIGS. 1 to 3.

Positioning shim 20 is formed either by two different parts, or by a monoblock part, or by two parts assembled to one another.

Positioning shim 20 can also be made from flexible plastic material and can be attached to closed first turn 18*a* of strap 15 by seams.

The invention claimed is:

1. An attachment device with a buckle for adjusting and clamping a strap, said buckle comprising a pair of superposed rings presenting rectangular frames of different dimensions, a larger first ring of the pair of superposed rings comprising a first rectangular opening located under a second rectangular opening arranged in a smaller second ring of the pair of superposed rings so as to define a transverse slot for passage of the strap, said slot being arranged between an outer edge of the second ring, and an adjacent side of the first rectangular opening of the first ring, the buckle being located either in a blocking position of the strap in the transverse slot when tensioning is performed, or in a releasing position after a relative movement between the pair of superposed rings resulting in an increase of a passage area in the slot, wherein the buckle is associated with a positioning shim housed opposite the transverse slot, surrounding a first closed turn of the strap, said positioning shim separating a top strand and a bottom strand of said first closed turn from one another to reduce a friction effect when relative movement takes place between the pair of superposed rings, and wherein the positioning shim is equipped with two guide apertures through which the bottom strand and the top strand of the first closed turn attached to the buckle respectively pass.

2. The attachment device according to claim 1, wherein the two guide apertures are separated from one another by an intermediate wall acting as a stop for the first ring.

3. The attachment device according to claim 2, wherein the intermediate wall of the shim is in the form of a wedge.

4. The attachment device according to claim 2, wherein the intermediate wall of the shim is extended opposite the stop by a nose salient from the two guide apertures in the direction of a seam of the first closed turn.

5. The attachment device according to claim 1, wherein the positioning shim and the buckle are formed by two distinct parts.

6. The attachment device according to claim 1, wherein the positioning shim is formed by a monoblock part, or by two parts assembled to one another.

7. The attachment device according to claim 1, wherein the positioning shim is made from flexible plastic material.

8. The attachment device according to claim 1, wherein the positioning shim is attached to the first closed turn of the strap by stitching.

* * * * *